United States Patent [19]

Bauer et al.

[11] Patent Number: 4,733,210

[45] Date of Patent: Mar. 22, 1988

[54] AUXILIARY SWITCH HOOKUP ASSEMBLY IN A MOTOR CONTACTOR

[75] Inventors: Johann Bauer, Ebermannsdorf; Klaus-Dieter Paul, Sulzbach-Rosenberg, both of Fed. Rep. of Germany

[73] Assignee: Siemens Aktiengesellschaft, Munich, Fed. Rep. of Germany

[21] Appl. No.: 922,700

[22] Filed: Oct. 24, 1986

[30] Foreign Application Priority Data

Nov. 6, 1985 [DE] Fed. Rep. of Germany ... 8531355[U]

[51] Int. Cl.[4] ..... H01H 9/02; H01H 67/02

[52] U.S. Cl. ..... 335/132; 335/202

[58] Field of Search ..... 200/17 R, 18, 293–296, 200/16 A; 335/132, 202, 262

[56] References Cited

U.S. PATENT DOCUMENTS

| | | | |
|---|---|---|---|
| 3,436,497 | 4/1969 | Mading | 200/16 A |
| 3,609,604 | 9/1971 | Schleicher | 335/202 X |
| 3,813,621 | 5/1974 | Blum | 335/202 X |
| 3,870,980 | 3/1975 | Pollman | 335/202 |
| 4,100,517 | 7/1978 | Rodolfi | 335/202 X |

FOREIGN PATENT DOCUMENTS

| | | |
|---|---|---|
| 1760279 | 1/1958 | Fed. Rep. of Germany . |
| 3423177 | 8/1985 | Fed. Rep. of Germany . |

*Primary Examiner*—J. R. Scott

*Attorney, Agent, or Firm*—Kenyon & Kenyon

[57] ABSTRACT

An auxiliary switch hookup assembly in a motor contactor includes a slide member biased by a spring and forming a portion of the limiting wall for the reception of an auxiliary switch. The spring force exerted by the biasing spring can be greater than a total force exerted by restoring and contact compression springs of the motor contactor.

12 Claims, 8 Drawing Figures

AUXILIARY SWITCH HOOKUP ASSEMBLY IN A MOTOR CONTACTOR

BACKGROUND OF THE INVENTION

This invention relates to an auxiliary switch hookup assembly in a motor contactor.

As disclosed in German Patent Document (Offenlegungsschrift) No. 2,248,029, an auxiliary switch hookup to a motor contactor includes an operating projection which protrudes from a housing of the auxiliary switch into an adapted opening of a contact bridge support of the motor contactor. The auxiliary switch is secured by screws to the motor contactor housing. In such an arrangement, the excursion of the magnet of the motor contactor must be shorter than the possible excursion of the auxiliary switch. Moreover, the auxiliary switch must be specifically adapted to the motor contactor, which adaptation is not readily performed by the customer.

An object of the present invention is to provide an improved auxiliary switch hookup assembly of the above-described type.

Another, more particular, object of the present invention is to provide such an auxiliary switch hookup assembly wherein compensation for a magnet excursion can be achieved without difficulty.

SUMMARY OF THE INVENTION

An auxiliary switch hookup assembly in a motor contactor comprises, in accordance with the present invention, an auxiliary switch including an auxiliary switch housing and an operating projection protruding from the housing. A contact bridge support disposed in the motor contactor is provided with an opening, the operating projection of the auxiliary switch being insertable through the opening and engageable with edges defining that opening. A slide member is slidably mounted to the motor contactor and defines at least a portion of an aperture limiting wall for operation of the auxiliary switch. A first set of springs, including at least one contact compression spring in the motor contactor, ensures conductor engagement of contacts upon actuation of the auxiliary switch and restores the auxiliary switch to a neutral position upon deactuation of the switch. A biasing spring engaging the slide member has a spring constant greater than a combined spring constant of the set of springs, whereby the biasing spring can exert a spring force greater than a total force exerted by the set of springs.

Ram drives for push-buttons switches with relatively great secondary movement are known in the art, as seen in German Utility Model (Gebrauchsmuster) No. 1,760,279.

Pursuant to a particular feature of the present invention, the auxiliary switch hookup assembly further comprises camming elements for inducing a slide displacement during an insertion of the operating projection through the opening in the contact bridge support. The camming elements include a beveled element on a side of the opening opposite the slide member and further include an abutment on the slide member proximate to the opening in the contact bridge support. The beveled element, located on the aperture limiting wall, and the abutment on the slide member serve to eliminate the slack between the contact bridge support and the operating projection of the auxiliary switch.

Pursuant to another particular feature of the present invention, the slide member engages a locking projection at the contact bridge support in the spring opening direction, whereby the displacement of the slide member is limited as the operating projection is being introduced into the opening in the contact bridge support. The locking projection is advantageously located on a separate guide part mounted to the motor contactor for guiding the contact bridge support. In addition, the beveled camming element may be formed on the guide part.

In order to facilitate use of the same auxiliary switch type or model for motor contactors having different magnet excursions, thereby enabling the user to exchange auxiliary switches, the auxiliary switch hookup assembly in accordance with the present invention includes an intermediate part provided with a snap connection for fitting the auxiliary switch to the motor contactor. The intermediate part is advantageously formed in the shape of a U having a pair of leg portions interconnected by a crossbar portion. The crossbar portion is preferably provided with slots for screwing the U-shaped intermediate part to the motor contactor housing. One leg portion of the U-shaped intermediate part is provided with one or more openings for receiving respective mushroom-shaped elements on the auxiliary switch housing, the other leg portion of the intermediate part having projecting lock elements such as beads engageable with the auxiliary switch housing.

In accordance with yet a further feature of the present invention, the crossbar portion of the intermediate part is provided with a clamping spring protruding from the crossbar portion towards the auxiliary switch for performing a clamping function in a snap-in state of the auxiliary switch hookup assembly.

DETAILED DESCRIPTION

Figure 1:
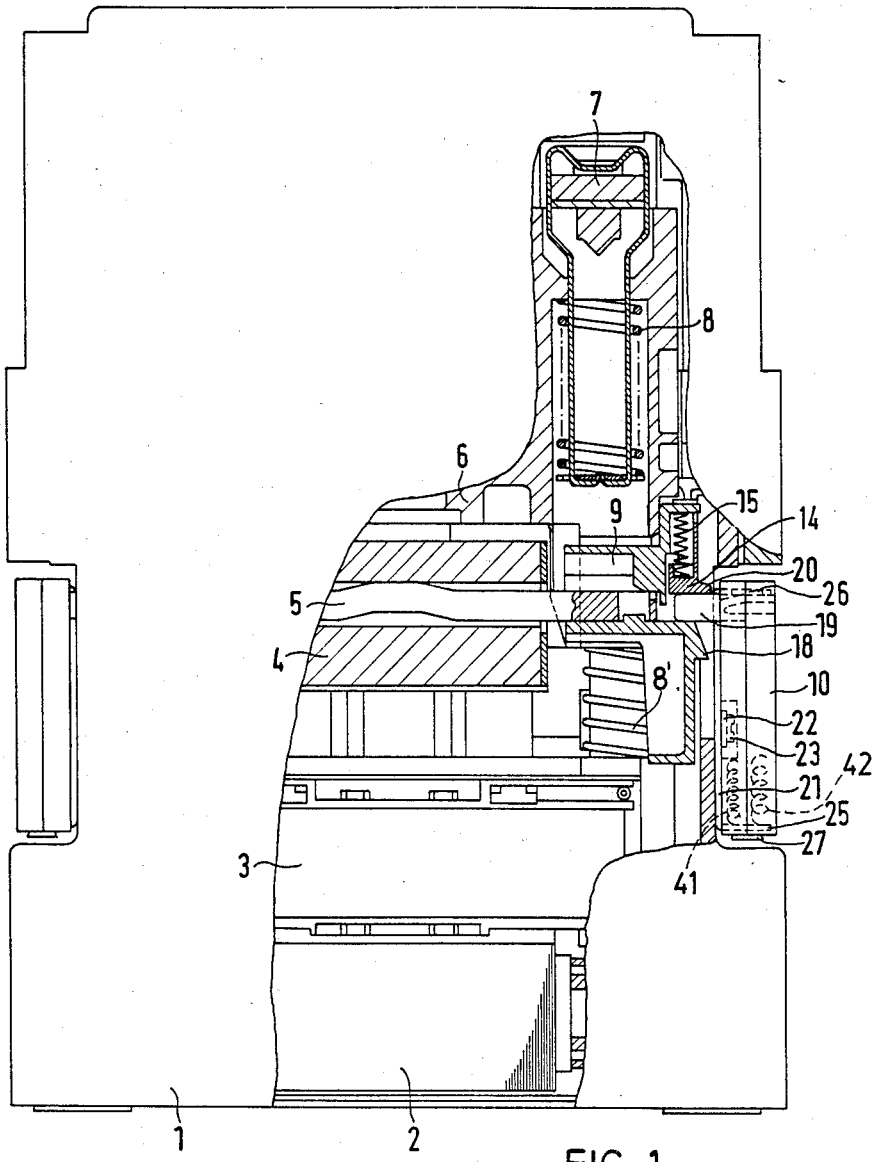
FIG. 1 is a side elevational view, partially in cross-section, of a motor contactor with an auxiliary switch hookup assembly including a slide member and an auxiliary switch, in accordance with the present invention.

As illustrated in FIG. 1, a motor contactor 1 comprises a housing 1, a fixed magnetic part 2 and a magnet coil 3. A movable magnet part 4 is articulatedly connected by a bolt 5 with a contact bridge support 6 to which contact bridges 7 and associated contact compression springs 8 and at least a pair of return pressure springs 8' are mounted. Return pressure springs 8' urge contact bridge support 6, contact bridges 7 and associated contacts (not shown) into a "contact open" position in which support 6 is raised as illustrated on FIG. 1. Upon energization of magnetic coil 3, magnet part 4 and support 6 are drawn downwardly to establish conductive engagement of the electrical contacts.

Inserted in contact bridge support 6, for purposes of ensuring positive coupling or union, are guide parts 9 (only one shown in the drawing figures) which serve to guide contact bridge support 6 and to couple auxiliary switch 10 to motor contactor 1. Integrally formed in guide part 9 are guide bars 11 which protrude into a cutout 12 and which matingly cooperate with grooves 13 in a slide member 14 to slidably mount slide member 14 to contact bridge support 6. In cutout 12 is retained a biasing spring 15 engageable with slide member 14 for resiliently opposing motion thereof. Spring 15 is supported in part against a limiting wall of cutout 12 (an aperture limiting wall) and in part against a bottom portion 31 of slide member 14.

Figure 2:
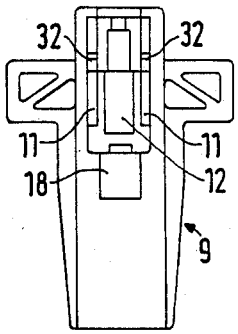
FIG. 2 is a front elevational view of a guide part included in the auxiliary switch hookup assembly of FIG. 1, the guide part being connected to a contact bridge support for receiving the slide member shown in FIG. 1.
Figure 5:
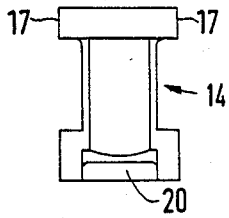
FIG. 5 is a front view of the slide member of FIGS. 1, 3 and 4.
Figure 3:
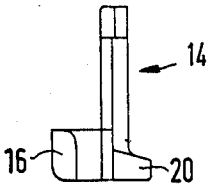
FIG. 3 is a side elevational view of the slide member shown in FIG. 1 and connectable to the guide part of FIG. 2.
Figure 4:
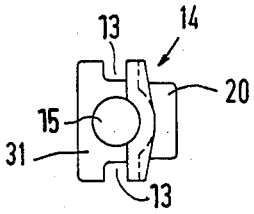
FIG. 4 is a top view of the slide member of FIGS. 1 and 3.
Figure 6:
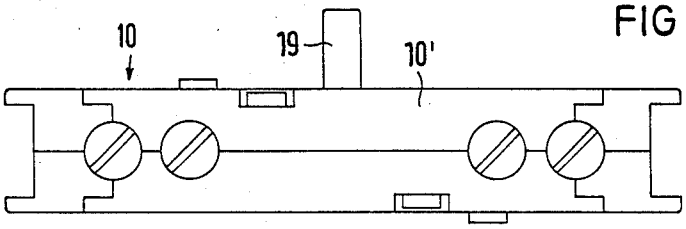
FIG. 6 is a top view of the auxiliary switch illustrated in FIG. 1.
Figure 7:
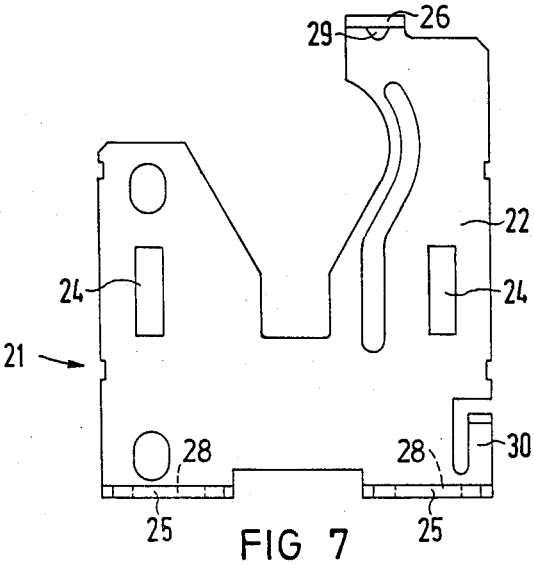
FIG. 7 is a front view of an intermediate part included in the auxiliary switch hookup assembly of FIG. 1.
Figure 8:
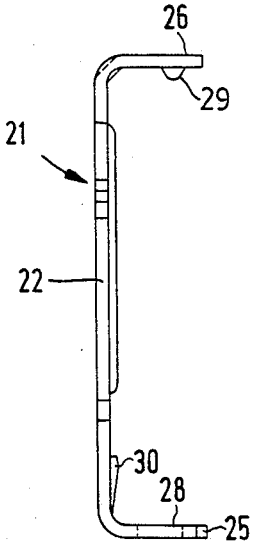
FIG. 8 is a side view of the intermediate part of FIGS. 1 and 7.

Slide member 14 (FIGS. 3–5) is formed at a base or bottom portion 31 with a pair of ears or flanges 16 serving in part to define grooves 13. Flanges 16 are only so wide that they and the associated forward section of bottom portion 31 can be introduced under guide bars 11 of guide part 9 into cutout 12 after spring 15 has been installed. Upon compression of biasing spring 15, bars 11 are inserted into grooves 13 while projections 17 at an upper side of slide member 14 (see FIG. 5) are locked in behind respective lock projections 32 on guide bar 9 (see FIG. 2).

A beveled element 18 (FIGS. 1 and 2) and an abutment 20 on slide member 14 (FIGS. 3–5) serve to induce a displacement of slide member 14 during an insertion of an operating projection 19 of an auxiliary switch 10 through an opening in the motor contactor. The opening is defined partially by guide part 9, operating projection 19 of the auxiliary switch 10 being brought into contact with guide part 9 and hence with contact bridge support 6 without clearance or play owing to the disposition of slide member 14 and to the loading or biasing thereof by spring 15. Slide member 14 moves in opposition to the force exerted by biasing spring 15 during the insertion of operating projection 19.

Operating projection 19 of auxiliary switch 10 is entrained to support 6, whereby a shifting of projection 19 downwardly if FIG. 1 results in a downward motion of support 6, contact bridge 7 and the associated electrical contacts to form an electrical connection. As discussed hereinabove, projection 19 is held against support 1 by the action of spring 15 and slide 14.

As illustrated schematically in FIG. 1, auxiliary switch 10 is provided with a contact compression spring 41 and a return pressure spring 42 in positions within the housing of auxiliary switch 10 well known to those skilled in the art. Contact compression spring 41 ensures conductive engagement of contacts in the auxiliary switch upon the actuation thereof, while return pressure spring 42 restores the auxiliary switch to a neutral position upon a deactuation of the auxiliary switch. Spring 15 is designed to overcome the combined force exerted by contact compression spring 41 and return pressure spring 42 and, concomitantly, spring 15 has a spring constant greater than the combined spring constant of the auxiliary switch springs.

For facilitating the mounting of auxiliary switch 10 to motor contactor 1, an intermediate part 21 is mounted to motor contactor 1. Intermediate part 21 is U-shaped and bent from a piece of sheetmetal. Intermediate part 21 has a pair of leg portions 25 and 26 connected to one another by a crossbar portion 22. Crossbar portion 22 is provided with slots 24 traversed by attachment screws 23 which fasten the intermediate part to the contactor. The relative positions of legs 25 and 26 can be predetermined with a caliper, whereby the auxiliary switch can be snapped into intermediate part 21 in the desired position and, if desired, can be exchanged without any adjustment being necessary.

Auxiliary switch 10 is provided with a housing 10' having at one side a mushroom-shaped projection 27 received by an opening 28 in leg portion 25 of intermediate part 21. Upon the insertion of mushroom-shaped projection 27 through opening 28, a lock element or projection 29 in the form of a bead on leg portion 26 of the intermediate part cooperates with a corresponding indentation (not illustrated) in the housing of auxiliary switch 10 to secure the switch to intermediate part 21.

Crossbar portion 22 of intermediate part 21 is provided with a spread spring 30 facing auxiliary switch 10 for clamping the intermediate part and the auxiliary switch to one another. In this manner, auxiliary switch 10 is connected to the housing of motor contactor 1 without play. To prevent any oscillation of auxiliary switch 10 two openings 28 in leg portion 25 and two associated mushroom-shaped projections 27 on housing 10' of auxiliary switch 10 are advantageously provided.

An auxiliary switch hookup assembly in accordance with the present invention, including guide part 9, switch member 14, biasing spring 15, intermediate part 21 and auxiliary switch 10, has the advantage that the operating projection 19 can reach the abutment for auxiliary switch 10 before the magnet excursion can be increased through the excursion of slide 14, i.e., the tolerances may be must greater. The design and assembly of an auxiliary switch hookup assembly in accordance with the present invention is simple and easy.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the descriptions and illustrations herein are proffered by way of example to facilitate comprehension of the invention and should not be construed to limit the scope thereof.

What is claimed is:

1. An auxiliary switch hookup assembly in a motor contactor, comprising:

a motor contactor housing;

an auxiliary switch including an auxiliary switch housing and an operating projection protruding from said housing;

mounting means for releasably mounting said auxiliary switch housing to said motor contactor housing;

support means movably disposed in said motor contactor housing for supporting a contact bridge, said support means being provided with an opening, said operating projection being insertable through said opening and engageable with edges in said support means defining said opening so that said operating projection and said support means are entrained to one another to enable said operating projection to shift said support means;

a slide member slidably mounted to said support means and defining at least a portion of an aperture limiting wall for operation of said auxiliary switch;

first spring means including a contact compression spring and a return pressure spring disposed in said auxiliary switch for ensuring conductive engagement of contacts upon actuation of said auxiliary switch and for restoring said auxiliary switch to a neutral position upon a deactuation of said auxiliary swtich, said first spring means having a combined spring constant; and second spring means for biasing said slide member against said operating projection to hold said operating projection against said support means, said second spring means having a spring constant greater than said combined spring constant, whereby said second spring means can exert a spring force greater than a total force exerted by said first spring means.

2. The auxiliary switch hookup assembly set forth in claim 1, further comprising camming means on said support means for inducing a slide displacement upon an insertion of said operating projection through said opening during a mounting of said auxiliary switch housing to said motor contactor housing, said camming means including a beveled element on a side of said opening opposite said slide member and further including an abutment on said slide member proximate to said opening.

3. The auxiliary switch hookup assembly set forth in claim 2 wherein said support means comprises guide means including a separate guide part for guiding said slide member, said beveled element being formed on said guide part.

4. The auxiliary switch hookup assembly set forth in claim 3 wherein said guide is provided with a lock projection engageable with said slide member upon a compression of said second spring means upon an insertion stroke of said operating projection during a mounting of the auxiliary switch housing to the motor contactor housing.

5. The auxiliary switch hookup assembly set forth in claim 4, wherein said mounting means includes an intermediate piece provided with means including a snap connection for mounting said auxiliary switch to said motor contactor housing, said intermediate piece being attached to said motor contactor housing.

6. The auxiliary switch hookup assembly set forth in claim 5, wherein said intermediate piece is U-shaped and has a pair of leg portions connected to one another by a crossbar portion, said crossbar portion having slots traversed by screws fastened to said motor contactor housing, said auxiliary switch housing having a mushroom-shaped element, one of said leg portions having an opening receiving said mushroom-shaped element, another one of said leg portions being formed with an additonal lock projection engageable with said auxiliary switch on a side thereof opposite said mushroom-shaped element.

7. The auxiliary switch hookup assembly set forth in claim 6 wherein said additional lock projection takes the form of a bead.

8. The auxiliary switch hookup assembly set forth in claim 6 wherein said crossbar portion is provided with a clamping spring protruding towards said auxiliary switch.

9. The auxiliary switch hookup assembly set forth in claim 1 wherein said support means comprises guide means including a separate guide part for guiding said slide member, said guide part being provided with a lock projection engageable with said slide member upon a compression of said second spring means upon an insertion stroke of said operating projection during a mounting of said auxiliary switch housing to said motor contactor housing.

10. The auxiliary switch hookup assembly set forth in claim 1 wherein said mounting means includes an intermediate piece provided with means including a snap connection for mounting said auxiliary switch to said motor contactor housing, said intermediate piece being attached to said motor contactor housing.

11. The auxiliary switch hookup assembly set forth in claim 10, wherein said intermediate piece is U-shaped and has a pair of leg portions connected to one another by a crossbar portion, said crossbar portion having slots traversed by screws fastened to said motor contactor housing, said auxiliary switch housing having a mushroom-shaped element, one of said leg portions having an opening receiving said mushroom-shaped element, another one of said leg portions being formed with an additional lock projection engageable with said auxiliary switch on a slide thereof opposite said mushroom-shaped element.

12. The auxiliary switch hookup assembly set forth in claim 11 wherein said crossbar portion is provided with a clamping spring protruding towards said auxiliary switch for cooperating with said mushroom-shaped element and the associated opening in one of said leg portions to clamp said auxiliary switch housing and said intermediate piece to one another and to thereby eliminate play.

* * * * *